US005876233A

United States Patent [19]

Choudhury et al.

[11] Patent Number: 5,876,233

[45] Date of Patent: Mar. 2, 1999

[54] ELECTRICAL CONNECTOR SYSTEM WITH CONNECTOR RETAINER

[75] Inventors: Apurba Choudhury; Quach Hung Huy, both of Rochester; Miles Frank Swain, Hayfield, all of Minn.

[73] Assignee: International Business Machines Corporation, Armonk, N.Y.

[21] Appl. No.: 815,788

[22] Filed: Mar. 12, 1997

[51] Int. Cl.[6] ..... H01R 13/62

[52] U.S. Cl. ..... 439/368; 439/362

[58] Field of Search ..... 439/368, 362, 439/364, 370, 373, 371, 470, 452, 449, 458, 544

[56] References Cited

U.S. PATENT DOCUMENTS

| | | | |
|---|---|---|---|
| 4,618,200 | 10/1986 | Roberts et al. | 439/449 |
| 4,935,847 | 6/1990 | Welsh | 439/362 |
| 5,011,427 | 4/1991 | Martin | 439/373 |
| 5,174,293 | 12/1992 | Hagiwara | 439/371 |
| 5,266,047 | 11/1993 | Black et al. | 439/364 |

FOREIGN PATENT DOCUMENTS

| | | | |
|---|---|---|---|
| 715611 | 1/1942 | Germany | 439/373 |

*Primary Examiner*—Paula Bradley
*Assistant Examiner*—Tho Dac Ta
*Attorney, Agent, or Firm*—Laurence R. Letson; Matthew J. Bussan

[57] ABSTRACT

An electrical connector system uses two electrical connector housings and two mating electrical connectors. The electrical connector housings are disposed on a support plate in an end to end relation and spaced apart by a distance smaller than twice the distance from the electrical connector housing to the fastener holding the connector to the connector housing. The fasteners are carried by and engaged with a retainer bar that further engages the connectors to pull the connectors into the connector housings and retain them in connection relationship, ensuring reliability of the connection.

5 Claims, 6 Drawing Sheets

ELECTRICAL CONNECTOR SYSTEM WITH CONNECTOR RETAINER

FIELD OF THE INVENTION

This invention relates to electrical connectors and electrical connector systems and, particularly, to leaf type electrical connectors for use where there is insufficient space to accommodate conventional leaf type electrical connectors.

BACKGROUND OF THE INVENTION

Leaf type electrical connectors are well known in the connector art and typically are mounted onto a base having threaded holes formed therein on each end of the connector housing. The threaded holes accommodate threaded fasteners attached to or incorporated into one portion of the connector which pull the connector on a cable into and maintain reliable, continuous contact between the electrical contacts of connector housing and the electrical contacts of the connector.

Alternatively, some connector housings are provided with wire or "spring" type latches which may be pulled up and engaged with complementary engaging surfaces on the electrical connector to insure that the electrical connector remains reliably attached to the electrical connector housing. The actual electrical connection is made by a male member supporting a plurality of leaf connectors or contacts on typically two sides of the male member, which then is inserted into a complementarily shaped female member containing similar electrical leaf contacts to engage with the contacts on the male member. After plugging the two elements together, the electrical connector housing assembly is engaged by the threaded retaining fastener extending through the support member of a leaf electrical connector and the fastener tightened to hold the two elements together. Alternatively, a spring latch may be used instead of the threaded fastener to maintain reliable electrical contact between the electrical connector and the electrical connector housing.

In some environments, space is extremely constrained and it is still necessary to provide a plurality of such connectors and connector housings of standard size, typically adjacent to each other, but which also consume scarce or non-existent space. Due to these space constraints in some instances, two such connectors and connector housings may not be positioned adjacent to each other and still be positioned within the confines of the allocated space. One alternative is to reduce the size of the connectors and connector housings and, therefore, the size of the contact leafs. This approach may require non-standard devices and threatens the reliability of the connectors and the resultant connection and, therefore, is not desirable.

Where the space constraints are rigid, there is no effective alternative such as increasing the allocated space for the connector. More efficient use of the limited space becomes the alternative. The more efficient use of the available space requires alternatives to the prior art techniques and devices.

OBJECTS OF THE INVENTION

It is an object of the invention to provide a connector system having two connectors disposed in a side-by-side relationship, but consuming less space than the comparable conventional connectors, when disposed as individual discreet connectors, without reduction in size of the operative electrical components of the connectors.

A further object of the invention is to maintain the size and spacing of the electrical contacts in the connectors and connection housings at a standard size and spacing while reducing the overall size of the connector system.

SUMMARY OF THE INVENTION

An electrical connector system is fabricated from components of a standard leaf type connector and then mounted into or onto a plate for support and attachment. The plate supports the connector housing components such that the distance between the two adjacent connector housings is less than the space that would be required if standard connectors were used and the fasteners for these standard connectors were afforded room intermediate the adjacent connectors.

The connectors which are then interconnected with the connector housings are provided without either the threaded fasteners typical of such connectors, or the wire latch catches, which are also typical of some of the conventional connectors.

In order to assure that the connector stays connected with the connector housing and provides reliable electrical connection through the connector and the connector housing, a retainer bar is provided. The retainer bar is formed to have two openings which fit over the electrical connectors terminating the cables attached to the electrical connectors and the strain relief bar carries two threaded fasteners, which may be engaged with the threaded holes on the plate supporting the connector housings. The retainer bar is further provided with cable slots extending through the side thereof and communicating with the openings that fit over the electrical connections to allow insertion of the cable into the opening and the relief bar.

A more complete understanding of the invention may be acquired from the attached drawings and the Detailed Description of the Invention to follow.

DETAILED DESCRIPTION OF THE INVENTION

The following is a detailed description of the best mode contemplated by the inventors for carrying out their invention.

Figure 1:
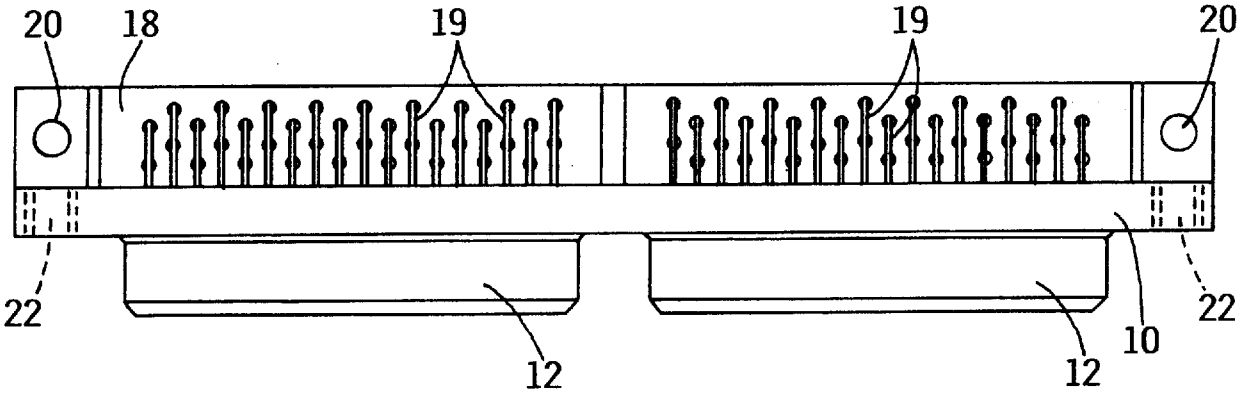
FIG. 1 is a top view of a portion of a connector system assembly with two connector housings disposed side-by-side.
Figure 2:
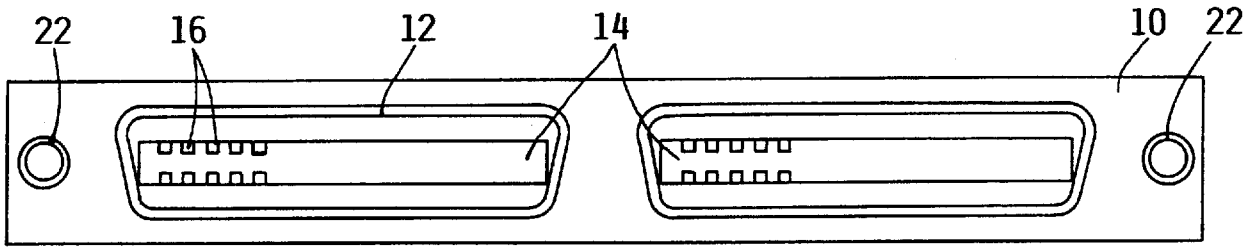
FIG. 2 is a front view of a electrical connector system housing with the connector housings disposed side-by-side and with fastener openings disposed at the ends of the plate.

With reference to FIGS. 1 and 2, the electrical connection system plate 10 is illustrated as supporting the electrical connector housings 12. Electrical connector housings 12 contain therewithin a mating female member or recess 14, as best seen in FIG. 2. Mating female member 14 carries a plurality of electrical leaf connector contacts 16. The electrical leaf connectors contacts 16 are regularly spaced along both the top and bottom surfaces of female member 14, as disposed in FIG. 2. Extending from the back side of plate 10 are electrical wires or pins 19 extending from the contacts 16, that may be bent in a 90 degree angle form to extend through the rear portion 18 of plate 10 and provide wide enough spacing for easy and convenient wire connection and/or soldering. The rear portion 18 of plate 10 is provided with a pair of mounting holes 20 for attachment to the electronic device utilizing the electrical connecting system.

The electrical connection housings 12 are fabricated of sheet metal to provide an electrical shielding for the connection, as is conventional. Further provided in plate 10 are a pair of threaded holes 22 which will receive the threaded fasteners 32, as explained below.

Figure 6:
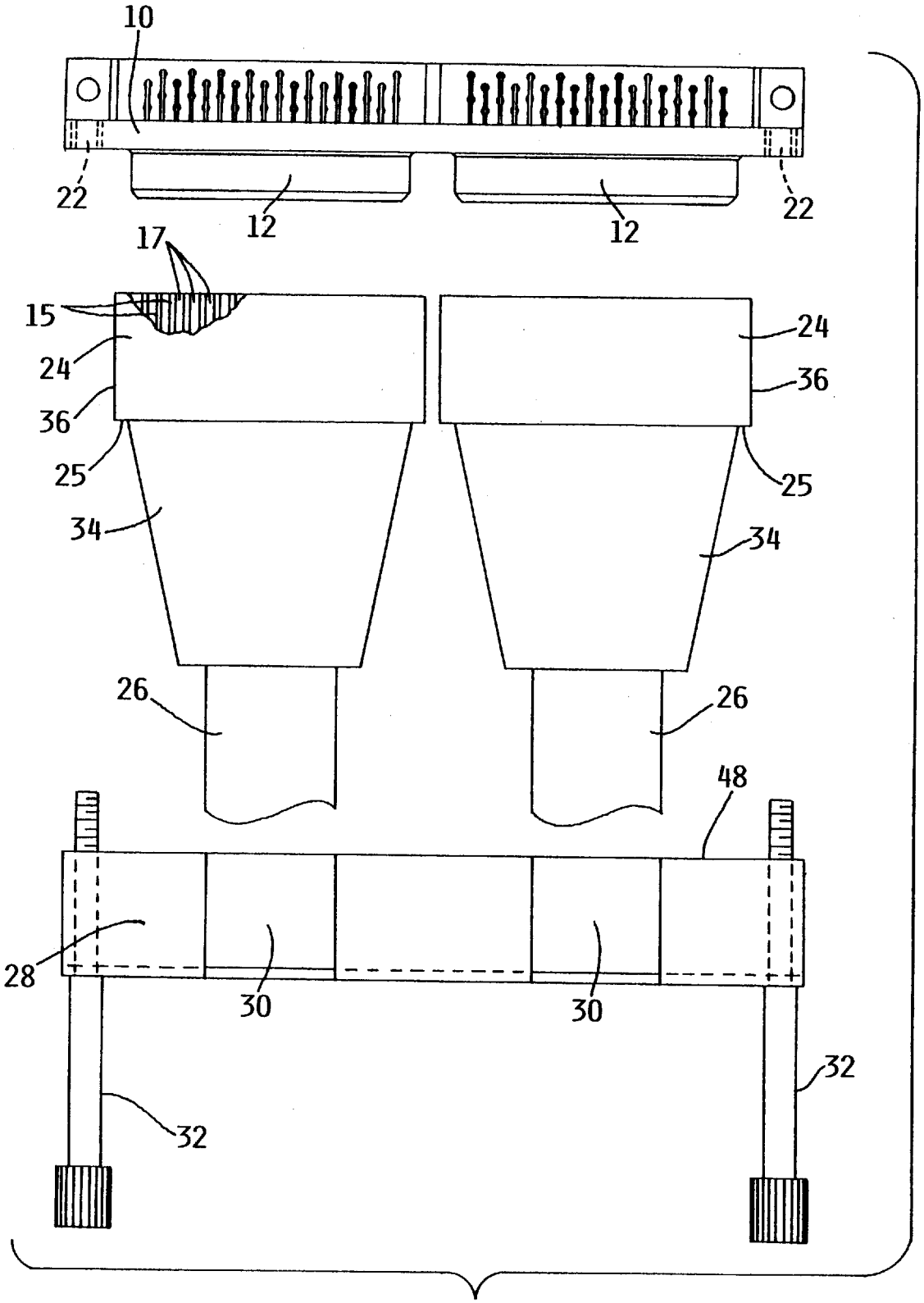
FIG. 6 is a top view of the connector system exploded to illustrate the plate and connector housings aligned with the cables and connectors and with the retainer bar further aligned with the connectors and the connector housings and plate.

Referring now to FIG. 6, the electrical connection system is shown with the electrical connector housings 12 aligned with electrical connectors 24. The electrical connectors 24 have an internal mating male projection 17 which carries thereon a plurality of electrical contacts 15 spaced and sized to make contact with the electrical leaf connector contacts 16 in the female structure 14 of the connector housing 12, as shown in FIG. 2, thereby providing electrical continuity between the cables 26 and the contacts 16. Electrical connectors 24 then may be pushed onto the electrical connector housings 12 and the retainer bar 28 then fitted over the electrical connectors 24.

Figure 3:
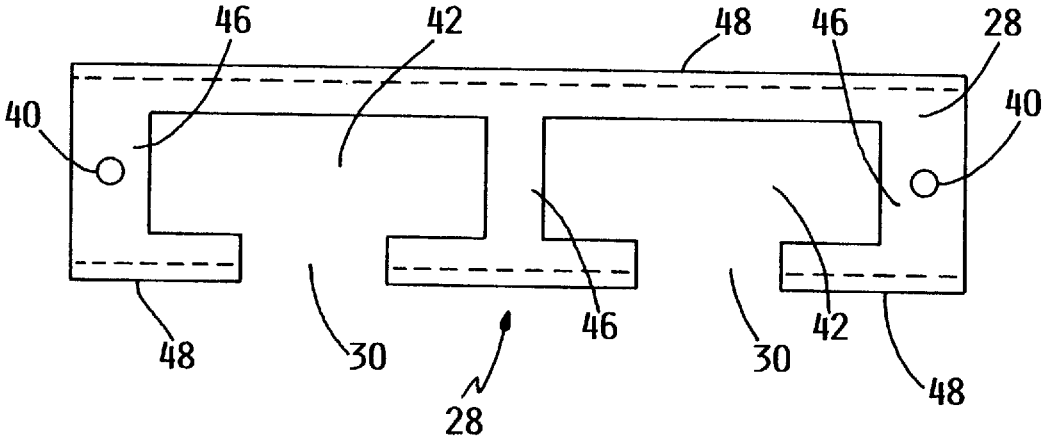
FIG. 3 illustrates a view of the retainer bar with the cable and connector openings as well as the cable removal slots and the fastener openings.

The details of the retainer bar 28 are illustrated in FIG. 3. The retainer bar 28 is preferably formed from a U-shaped channel of metal or high strength plastic. The retainer bar or U-shaped channel 28 may be formed from sheet metal by punching and bending or injected molded by using high strength plastic. The retainer bar 28 is formed in a U-shaped manner, with the base of the "U" being 46. The side walls of the U-shaped channel 28 are designated 48. Holes 40 are formed into the base 46 of the U-shaped channel 28 to accommodate and receive fasteners 32. Gaps or cable channels 30 are provided to permit insertion of the cable 26 into the opening 42 so that the retainer bar 28 may be fitted over a portion of the connector 24 without cable disassembly and reassembly.

Openings 42 are formed in the base portion of the U-shaped channel 28 to accept the trapezoidal portion 34 of the connector 24 and to abut base 46 against rear surface 25 of the rectangular section 36 of the connector 26. This engagement permits the threaded members to hold the retainer bar 28 against the connector 24 to ensure connection and engagement with the electrical connector housings 12.

Figure 4:
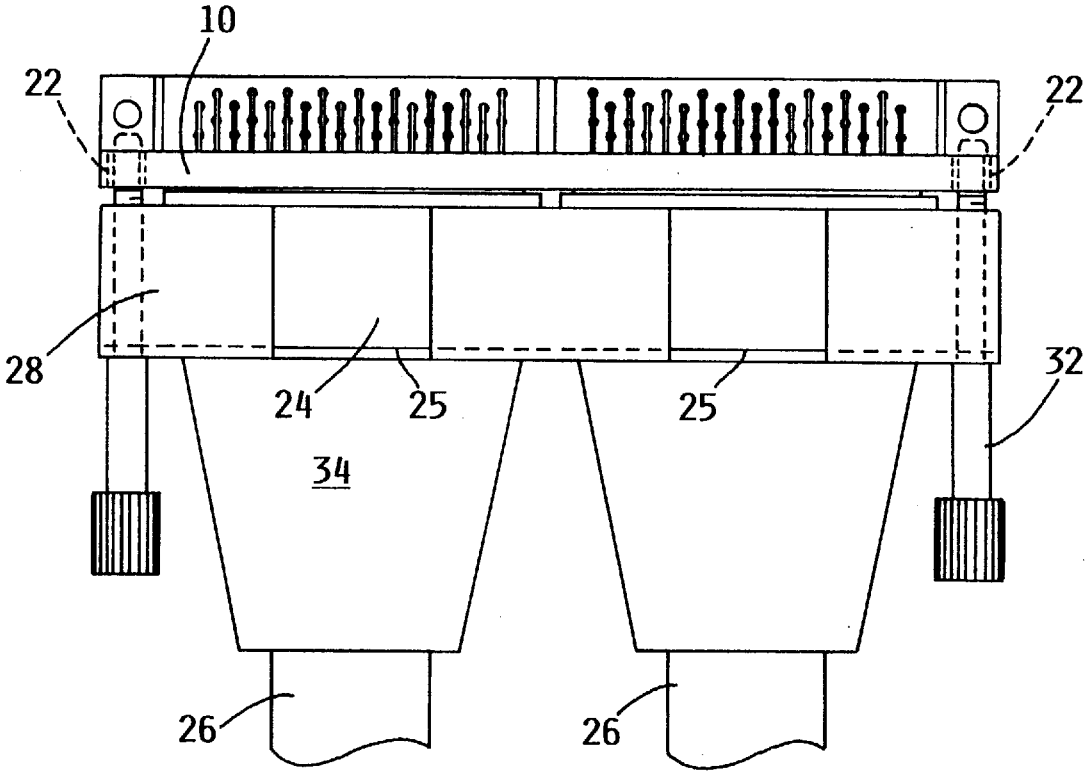
FIG. 4 illustrates the electrical connector system mated and fully assembled.

The channels or slots 30 permit the insertion of cables 26 into the retainer bar 28. The slots 30 extend from the holes 42 to the outside of the strain relief bar 28 and the cable connected to the connector 24 may be inserted through the slot 30 into the hole 42. Once assembled in that manner, as illustrated in FIG. 4, the threaded fasteners 32 then may be threaded and tightened into the threaded holes 22 in plate 10.

The spacing of the connector housing 12 and the connector 24 is such that the spacing of the adjacent connector housings 12 and therefore, adjacent connectors 24 are respectively spaced apart by a distance less than twice the distance between the fastener 32 and the connector 24. This spacing is permitted as a result of the elimination of the fasteners associated with the prior art connectors and the provision of the retainer bar 28 and the fastener 32 associated therewith.

One will appreciate that with this arrangement of connector housings, connectors, and retainer bar, connectors 24 may be positioned considerably closer together than would be possible using two completely independent prior art leaf-type connector systems. The elimination of the fasteners from the connectors 24 permits the disposal of the connectors 24 and the connector housings 12 much more closely together, thus saving space which, in turn, permits placement of such electrical connection system into an area which would not otherwise accommodate a comparable number of connectors 24.

Figure 5:
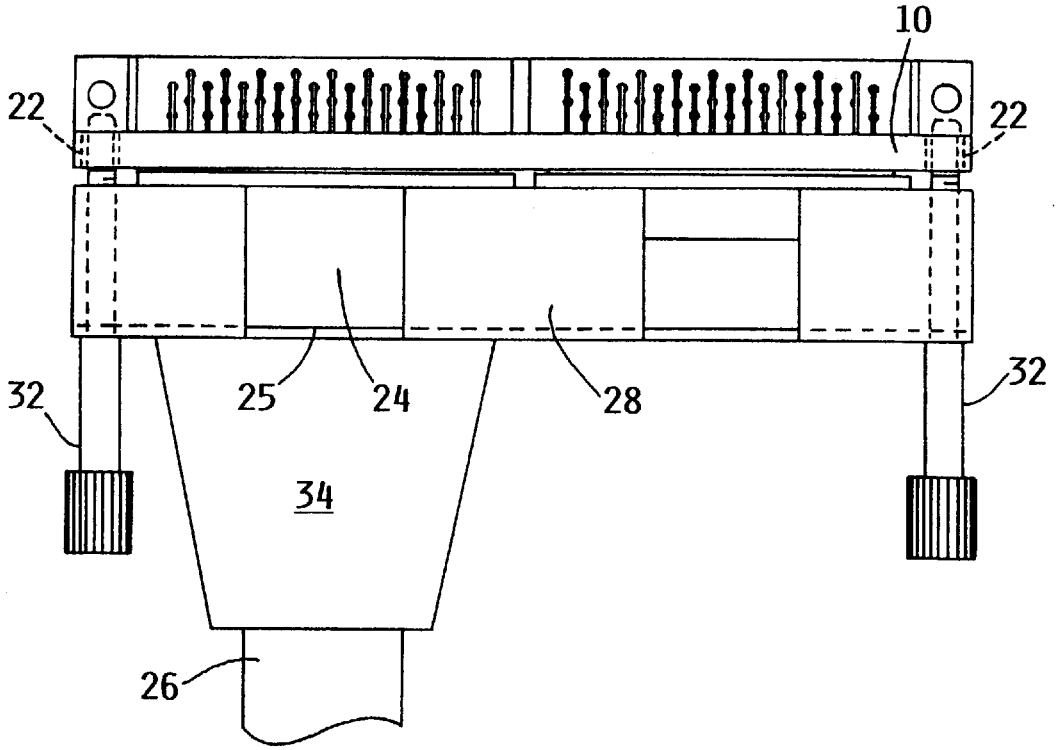
FIG. 5 illustrates the electrical connector system assembled with only one cable and electrical connector mated with the corresponding connector housing.

FIG. 5 shows the retainer bar 28 installed over and engaged with one connector 24. The fasteners 32 are tightened into holes 22 sufficiently to insure reliable engagement of the connector 24 and the connector housings 12 (not visible in FIG. 5). The configuration in FIG. 5 is used if only one connector 24 need be connected to a connector housing 12 on plate 10.

One of skill in the art will appreciate that pin and sockets connector systems may be used in lieu of the leaf type connectors discussed herein if the circumstances require and other minor changes and modifications may be made to the invention disclosed here without removing the resulting structure from the scope of the appended claims.

We claim:

1. An electronic connector and connector retaining system, comprising:

a first connector housing mounted on a first end of a plate;

a second connector housing mounted on a second end of said plate;

a first fastener mounted on said first end of said plate adjacent said first connector housing;

a second fastener mounted on said second end of said plate adjacent said second connector housing;

said first fastener and first connector housings defining a distance therebetween;

said first connector housing being closer to said second connector housing than twice the distance between said first fastener and said first connector housing; and a pair of connectors mateable with said connector housings and a retainer with openings for receiving a pair of cables connected to said connectors, said retainer having holes aligned with and receiving said fasteners for mounting said retainer to said plate, said openings each sized to accept and pass one end of one said connector and sized sufficiently small to prevent passage of other end of one said connector, whereby said retainer may exert a force against said connector to prevent said connector from disengaging from said connector housing so long as said retainer is mounted by said fasteners to said plate.

2. The electronic connector and connector retaining system of claim 1 wherein said retainer comprises a communicating passage between an exterior edge of said retainer and each said opening for said cables.

3. An electronic connector and connector retaining system comprising:

a first cable terminated in a first connector;

a second cable terminated in a second connector;

a retainer bar having first and second openings, respectively, receiving said first and second cables and a portion of said first and second connectors, said first and second openings being smaller than a portion of said first and second connectors so that said portion of said first and second connectors will not pass through said first and second openings, said first and second openings, respectively, having first and second cable removal slots, said retainer bar further having first and second fastener receiving holes, respectively, adjacent said first and second openings, said retainer bar comprising a length of U shaped channel having a bottom span and two side walls, said openings formed in said bottom span and said cable removal slots disposed into at least one of said side walls and communicating with said openings.

4. The electronic connector and connector retaining system of claim 3 further comprising a connector housing assembly comprising a pair of connector housings mateable with said connectors, said connector housings mounted onto a plate adjacent each other;

said connector housing assembly having a first pair of fastener engaging holes each of said fastener engaging holes disposed adjacent each connector housing and with said connector housings intermediate said holes;

said retainer bar having a second pair of holes aligned with said first pair of fastener engaging holes; and fasteners disposed in said second pair of holes and engaged with said first pair of holes to prevent disconnection of said connectors from said connector housings.

5. An electronic connector and connector retaining system, comprising:

a plurality of connector housings mounted adjacent each other on a plate, comprising:

a first connector housing mounted on a first end of said plate;

a second connector housing mounted on a second end of said plate;

a first fastener mounted on said first end of said plate adjacent said first connector housing;

a second fastener mounted on said second end of said plate adjacent said second connector housing;

said first fastener and said first connector housings defining a distance therebetween;

said first connector housing being closer to an adjacent connector housing than twice the distance between said first fastener and said first connector housing;

a first cable terminated in a first connector;

a second cable terminated in a second connector; and a retainer bar having a U shaped channel shape formed of a pair of walls and a bottom span and first and second openings for, respectively, receiving said first and second cables and formed into said bottom span, said first and second openings being smaller than a portion of said first and second connectors so that said portion of said first and second connectors will not pass through said first and second openings, said first and second openings, respectively, having first and second cable removal slots formed into one of said walls and communicating with said plurality of openings, said retainer bar further having two fastener receiving holes formed adjacent to ends thereof and a fastener received into said fastener receiving holes.

* * * * *